US005636465A

United States Patent [19]

Johnson

[11] Patent Number: 5,636,465

[45] Date of Patent: Jun. 10, 1997

[54] SPARE MAGAZINE CARRIER

[76] Inventor: David A. Johnson, 4460 Mathews Loop S., Salem, Oreg. 97302

[21] Appl. No.: 695,227

[22] Filed: Aug. 7, 1996

[51] Int. Cl.[6] ..... F41A 9/68

[52] U.S. Cl. ..... 42/90; 42/50

[58] Field of Search ..... 42/90, 18, 50, 42/49.01

[56] References Cited

U.S. PATENT DOCUMENTS

| | | | |
|---|---|---|---|
| 4,115,943 | 9/1978 | Musgrave | 42/90 |
| 4,484,404 | 11/1984 | Johnson | 42/90 |
| 4,628,627 | 12/1986 | Johnson | 42/90 |
| 5,279,059 | 1/1994 | Howard | 42/90 |

OTHER PUBLICATIONS

J.F.S., Inc. Boonie Packer Tactical and Range Accessories, Dec. 1995—note description beneath "Redi-Mag" heading.

*Primary Examiner*—J. Woodrow Eldred
*Attorney, Agent, or Firm*—Chernoff, Vilhauer, McClung & Stenzel

[57] ABSTRACT

A protective carrier for holding a loaded spare magazine in a position of readiness for immediate insertion into operative engagement with a firearm. A latch mechanism in the carrier is operable simultaneously with and in response to release of the magazine retaining catch mechanism of the firearm, permitting an empty magazine and a loaded spare magazine to be released together, the empty magazine being allowed to fall clear of the firearm while the loaded spare magazine is grasped and inserted into the firearm for use in a minimum amount of time. The spare magazine carrier of the invention protectively surrounds the open upper end of the spare magazine to shield cartridges held therein against contamination by dirt, mud, and the elements, in order to help avoid malfunction or damage of the firearm. A control device extender is provided to operate a bolt catch lever of a rifle which may be covered by the spare magazine carrier.

12 Claims, 5 Drawing Sheets

SPARE MAGAZINE CARRIER

BACKGROUND OF THE INVENTION

The present invention relates to repeating firearms, and particularly to an accessory for a repeating firearm using a replaceable magazine.

In land warfare the individual infantry soldier is still an important part of military operations. The effectiveness of the individual soldier depends to a large extent on the accuracy, rate of fire, and number of rounds of ammunition which each individual soldier is capable of providing. For that reason, modern infantry firearms are capable of high cyclic rates of fire and are usually equipped with magazines capable of holding dozens of cartridges. Such magazines must usually be manually released from the firearm when they have become empty, at which time a full magazine must be inserted into the firearm before firing may be continued. In order to be capable of sustained firing an infantry soldier carries loaded spare magazines, typically held in protective pouches attached to ammunition belts. When actually engaged in combat it is common for soldiers to carry spare magazines ready for more immediate use, since removal of a loaded magazine from a cartridge belt may take an undesirably long time.

It is clumsy, however, to carry a loaded spare magazine in one's hand, since it detracts from the ability to hold the firearm securely and aim it accurately.

While a longer period of sustained fire might be provided by simply using a larger magazine with the firearm, this solution is workable only so long as the increased size of the magazine does not interfere with convenient carrying or aiming of the firearm. Additionally, reliable cartridge feeding mechanisms for extremely large magazines may be somewhat complex and therefore undesirable.

In order to provide an ability to fire more rounds quickly, a spare magazine carrier as disclosed in Johnson U.S. Pat. No. 4,484,404, of which the disclosure is hereby incorporated herein by reference, allows a spare magazine to be carried alongside the receiver of a rifle, ready for immediate use. With certain automatic and semi-automatic rifles, however, the device disclosed in the mentioned U.S. Pat. No. 4,484,404 may partially obstruct access to a functional operating lever or button located on the receiver of such a rifle. In particular, the spare magazine carrier shown in U.S. Pat. No. 4,484,404 limits access to one part of a bolt catch operating lever on certain auto-loading rifles such as M-16 military rifles and Colt® AR15 rifles, making it more difficult to latch open the bolt of such a rifle, especially when the user is wearing gloves. It is therefore desired to provide an improved spare magazine carrier whose presence does not impede operation of the firearm with which it is associated.

SUMMARY OF THE INVENTION

The present invention meets the aforementioned need for a way to keep a loaded spare magazine quickly available to replace an empty magazine of a firearm such as an automatic or semiautomatic firearm without impeding its normal operation by providing an improved protective spare magazine to hold a loaded spare magazine securely adjacent to the receiver of such a firearm. An easily accessible functional control extender mechanism is provided on the spare magazine carrier to engage an operating control lever or button located on the firearm where it is covered or partially covered by the spare magazine carrier.

In one embodiment of the invention the functional control extender mechanism is a spring-biased plunger which may be pushed toward the receiver of the firearm on which the spare magazine carrier is mounted to engage a functional control device such as a button located on the receiver of the firearm.

In a preferred embodiment, the spare magazine carrier of the present invention comprises a box-like body portion including a top and sides which protectively surround the open upper or outfeed end of the loaded magazine. A catch included in the spare magazine carrier engages the magazine in the carrier in a manner similar to that by which the firearm itself engages the magazine.

A latch release mechanism is provided to engage a portion of the magazine release mechanism of the firearm so that operation of the magazine release mechanism also operates the latch release mechanism, in a preferred embodiment of the invention.

The foregoing and other objectives, features and advantages of the present invention will be more readily understood upon consideration of the following detailed description of the invention taken in conjunction with the accompanying drawings.

DETAILED DESCRIPTION OF THE INVENTION

Figure 1:
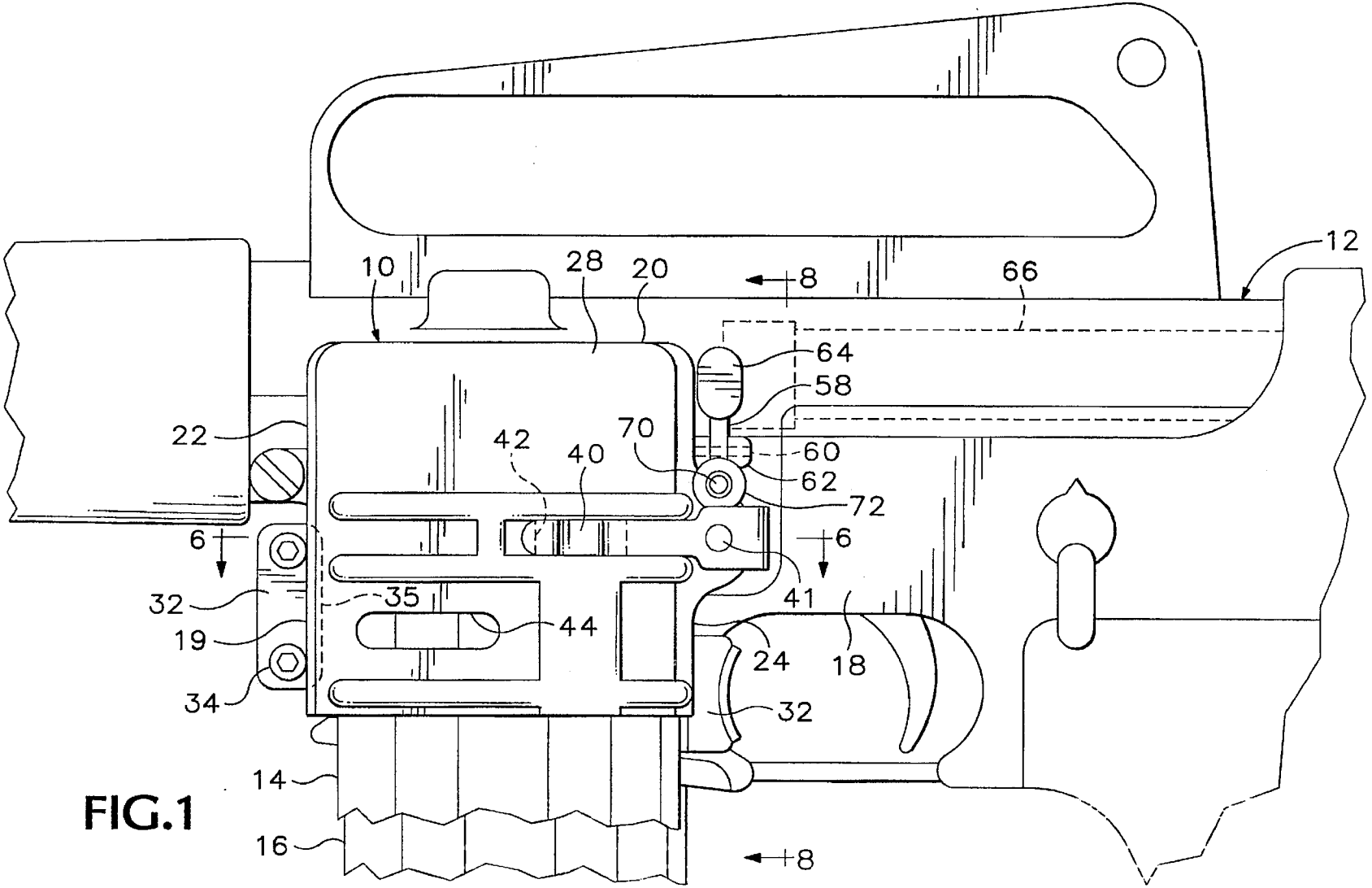
FIG. 1 is a left side elevational view of a portion of an automatic rifle together with a protective carrier for a spare magazine, embodying the present invention, attached thereto.
Figure 2:
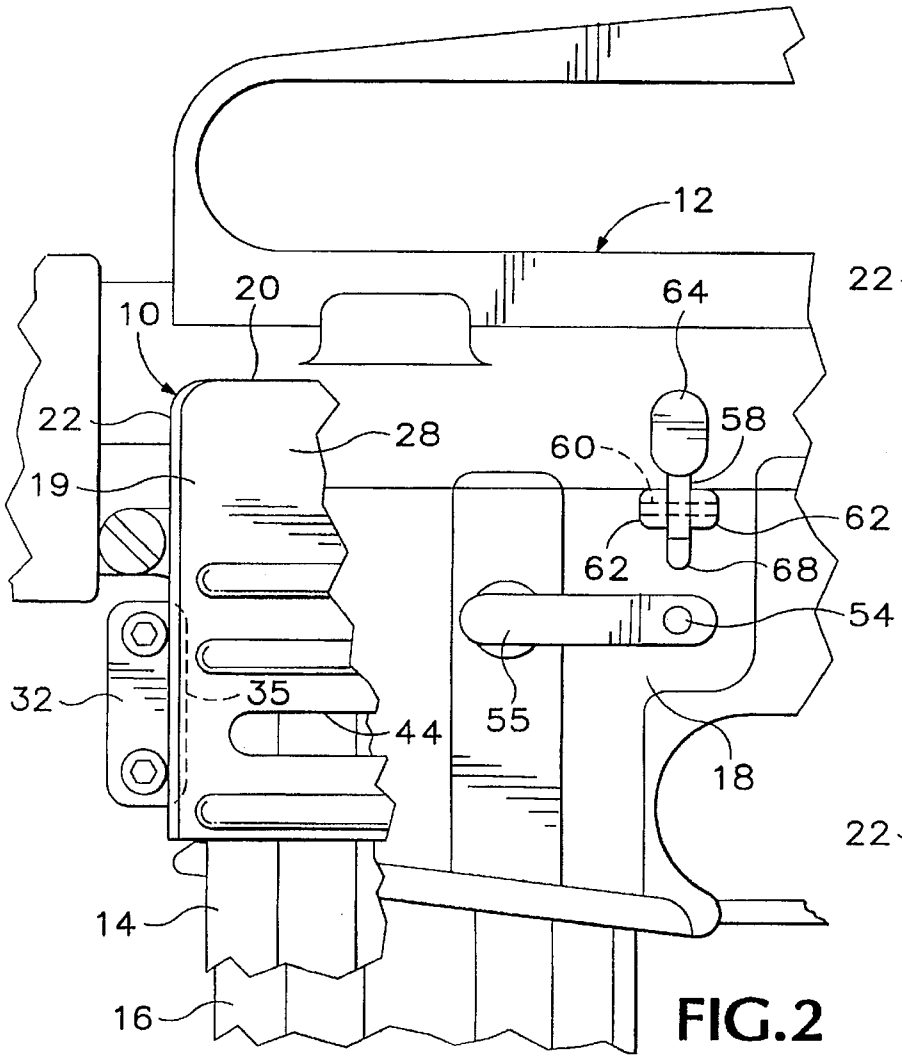
FIG. 2 is a view similar to a portion of FIG. 1, showing the protective spare magazine carrier partially cut away.
Figure 3:
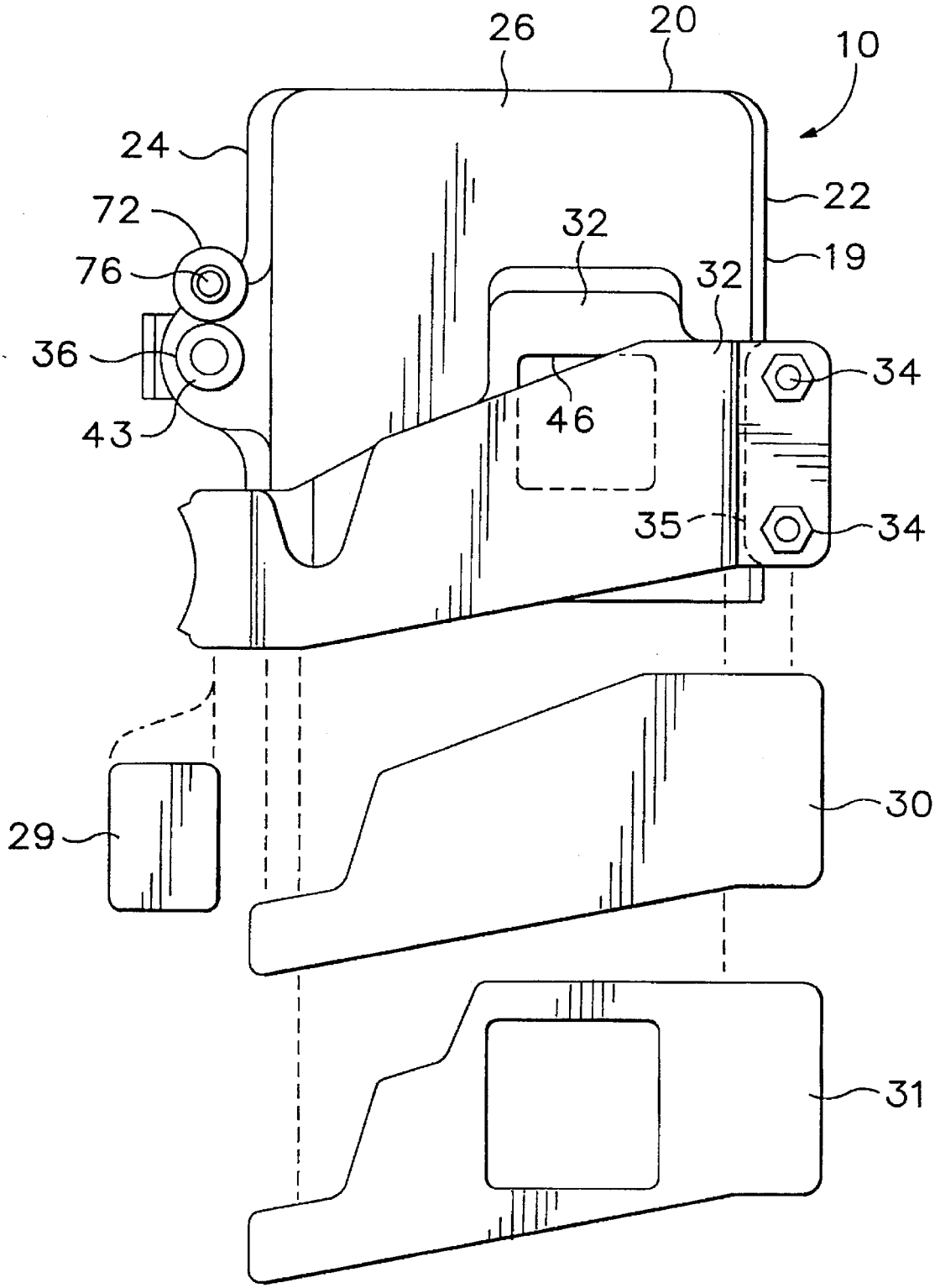
FIG. 3 is an elevational view of the right side of the spare magazine carrier shown in FIG. 1.
Figure 4:
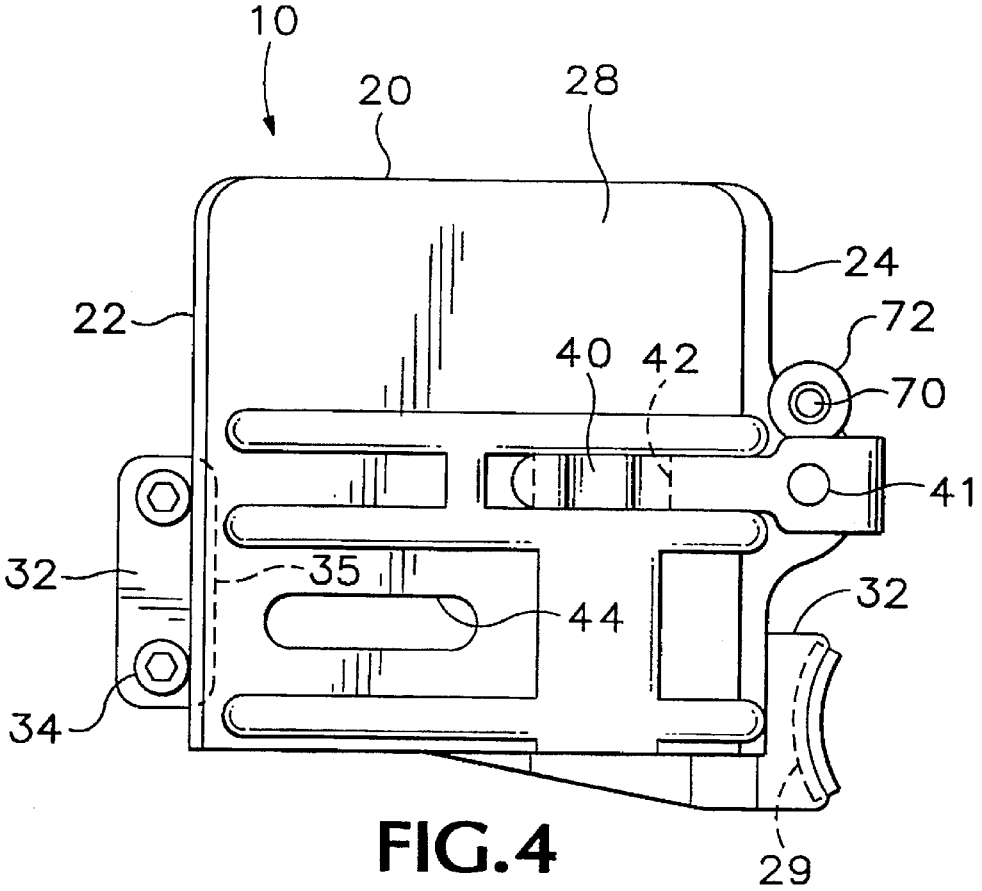
FIG. 4 is an elevational view of the left side of the spare magazine carrier shown in FIG. 1.
Figure 5:
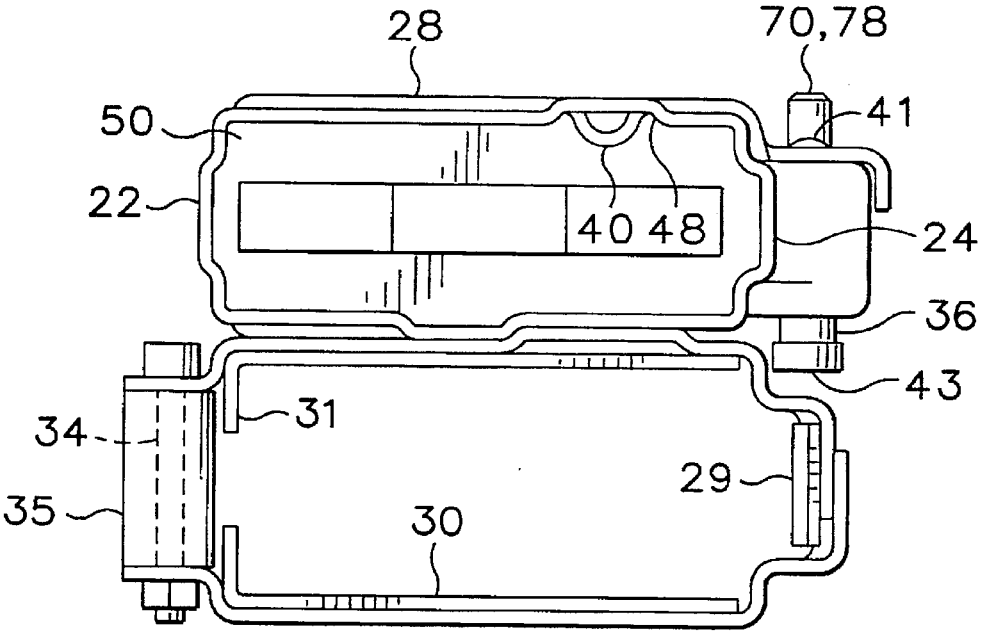
FIG. 5 is a bottom view of the spare magazine carrier shown in FIGS. 1 through 4.

Referring now to FIGS. 1 and 2 of the drawings, an exemplary spare magazine carrier 10 embodying the present invention is shown attached to an automatic rifle 12. A spare magazine 14 is held in the carrier 10, while a magazine 16 is engaged in the receiver 18 of the automatic rifle 12, ready for use. Referring also to FIGS. 3, 4 and 5, the carrier 10 may be made, for example, of pressed and welded sheet metal, and includes a body 19 having a top 20, a front side 22, a rear side 24, a right side 26, and a left side 28. An attachment strap 32, also of sheet metal, is fixedly connected with the right side 26, also by welding, for example. The attachment strap 32 extends around a portion of the receiver 18 of the rifle 12 and is held tightly by fasteners such as bolt and nut combinations 34, preferably with a set of gaskets 29, 30 and 31, of resilient sheet material such as a rubber-like plastic, and a spacer block 35 of similar material, to distribute pressure against the surface of the receiver 18. The gaskets 30 and 31 are shown extended flat in FIG. 3, but when installed are bent around the receiver 18 and fit inside the strap 32 as shown in FIG. 5.

Figure 6:
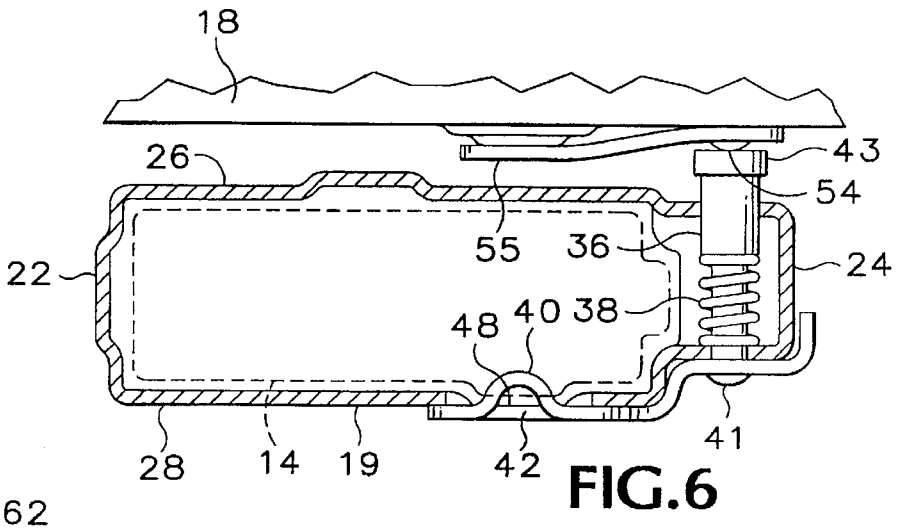
FIGS. 6 and 7 are sectional views of the spare magazine carrier and a portion of the rifle shown in FIG. 1, taken along line 6—6.
Figure 7:
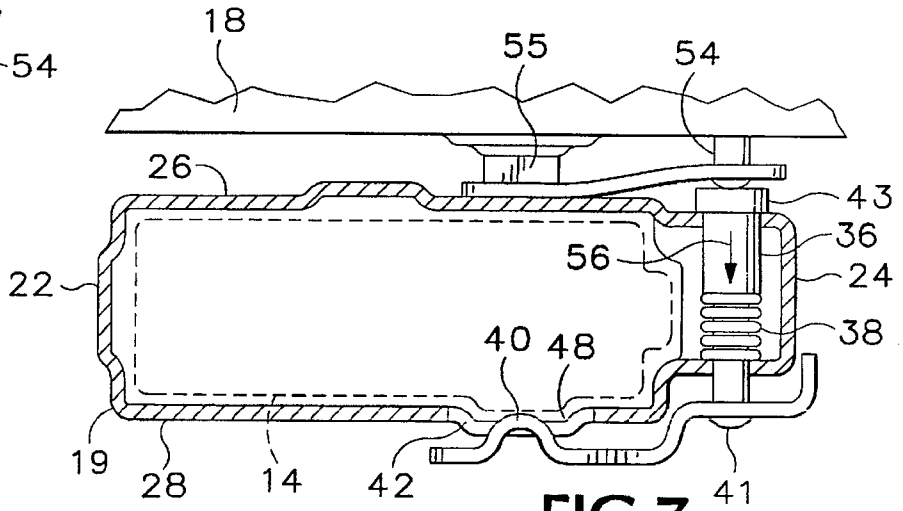

A latch mechanism, shown best in FIGS. 6 and 7, is incorporated in the spare magazine carrier 10 to releasably hold the spare magazine 14 and includes a plunger 36 urged toward the right side 26 by a helical spring 38. A catch 40, which may be an inwardly directed portion of a small metal strap, is fastened, as by riveting, to an outer end 41 of the plunger 36, and extends through an opening 42 defined in the left side 28. The inner end 43 of the plunger 36 is enlarged and extends to the right, beyond the right side 26 a small distance toward the receiver 18.

A portion of the left side 28 is offset outwardly, defining a channel 48 within the body 19, between the opening 42 and the open mouth 50 of the body 19, permitting a detent portion of a spare magazine 14 to pass upward within the carrier 10, to be engaged by the catch 40 to retain the spare magazine 14 with its open outfeed end within the carrier 10. An opening 44 is provided in the left side 28, and an opening 46 is defined through the right side 26 and the strap 32 to make the serial number of the rifle 12 visible while the spare magazine carrier 10 remains in place.

Referring particularly to FIGS. 2, 6, and 7, there is a push button (not shown) located on the right side of the receiver 18 of the rifle 12. Connected with the push button is a push rod 54 which extends transversely through the receiver 18 to a laterally movable, forwardly extending magazine retaining catch 55 of the automatic rifle 12. The push rod 54 and its push button are normally biased so that the button extends outwardly away from the right side of the receiver 18, but when the push button is depressed (pushed leftward) to release the magazine 16 from the receiver 18, the left end of the push rod 54 contacts the inner end 43 of the plunger 36, moving the plunger 36 in the direction indicated by the arrow 56 to the position shown in FIG. 7. This moves the catch 40 outwardly from its position in the opening 42, releasing the spare magazine 14 from its position within the carrier 10 substantially simultaneously with release of the magazine 16 from the receiver 18.

To use the carrier 10 of the present invention most advantageously, a rifleman will grasp the spare magazine 14 in his left hand while moving the push button leftward with his right hand. This allows the empty magazine 16 to be dropped from the receiver 18 and releases the spare magazine 14 into the rifleman's left hand, so that he may immediately insert the spare magazine 14 upwardly into position in the receiver 18. Releasing the push button once the spare magazine 14 has been disengaged from the carrier 10 enables the magazine retaining catch 55 of the automatic rifle 12 to engage and retain the spare magazine 14 once it has been inserted into position in the receiver 18. As a result the automatic rifle 12 may be extremely quickly reloaded once the magazine 16 has been emptied. Another loaded spare magazine may thereafter be inserted into the carrier 10 at the first convenient opportunity.

Certain rifles, for example the M-16 military automatic rifle and a similar civilian semi-automatic rifle, the Colt® AR15 rifle, like the rifle 12 shown in FIGS. 1 and 2, may include push-buttons or levers which act as functional control devices to initiate, prevent, or stop the action of mechanisms contained within the receiver of such rifles. Some of such push-buttons or levers may be located on the left side of the receiver where the body 19 of the spare magazine carrier 10 may prevent or partially obstruct access to such push-buttons or levers.

In particular, in the rifle 12 there is a bolt catch lever 58, also called a bolt hold-open lever, arranged to pivot about an axis defined by a pin 60 extending parallel with the length of the rifle 12, extending through the bolt hold-open lever 58 and a pair of gudgeons 62. When the upper end 64 of the bolt hold-open lever 58 is retracted away from the receiver 18, with the bolt 66, shown schematically in FIG. 1, manually held withdrawn rearwardly with respect to the receiver 18, the bolt hold-open mechanism engages the bolt 66 to hold it in its rearward position. When its upper end 64 is pressed rightward, or inwardly toward the receiver 18, it releases the bolt 66.

Ordinarily, the lower end 68 of the bolt hold-open lever 58 is also available to be pushed inwardly toward the receiver 18 causing the bolt hold-open lever 58 to pivot about the pin 60 to engage the bolt hold-open mechanism with the bolt 66. This is particularly useful when the user of the rifle is wearing gloves, since the upper end 64 is too small and too close to the receiver 18 to be grasped easily to withdraw it away from the receiver 18.

Because of the presence of the spare magazine carrier 10, however, the lower end 68 is not available easily to be pushed. Accordingly, the magazine carrier 10 according to the present invention includes an exposed control device extender by which the lower end 68 of the bolt hold-open lever 58 can be pushed. In the embodiment of the invention shown in FIGS. 1–8, the extender has the form of a plunger 70 mounted within a tubular housing 72 and biased outwardly, or leftward, by a helical spring 74 surrounding a portion of the plunger 70. The plunger housing 72 is mounted on the body 19 of the spare magazine carrier 10, as by being welded in place, with an inner, or right end 76 aligned with the lower end 68 of the bolt hold-open lever 58 when the spare magazine carrier 10 is fastened to the receiver 18 of the rifle 12. By pushing on the left or outer end 78 of the plunger 70, the user of the rifle 12 can press the lower end 68 of the bolt hold-open lever 58 to engage the bolt hold-open mechanism easily when the spare magazine carrier 10 is mounted on the rifle 12.

While the plunger housing 72 as shown herein is a separate structure attached to the body 19, it will be understood that a plunger similar to the plunger 70 could also be installed in a spare magazine carrier embodying the present invention by forming its body to include an appropriately located portion similar to the structure associated with and supporting the plunger 36 and helical spring 38 as described above and shown in the drawings forming a part of the disclosure herein.

It will also be understood that such a functional control device extender could be mounted on a spare magazine carrier in positions other than that shown herein, depending upon the location of a functional control device which must be operated with the spare magazine carrier attached to a particular firearm with which a spare magazine carrier embodying the invention is desired to be used. It thus may be necessary to have an enlargement or a transverse projection (not shown) attached to the right or inner end 76 of the plunger 70 in order to engage a functional control device on such a firearm, depending upon its location relative to the front side 22, rear side 24, or top 20 of the body 19 of the spare magazine carrier.

Figure 9:
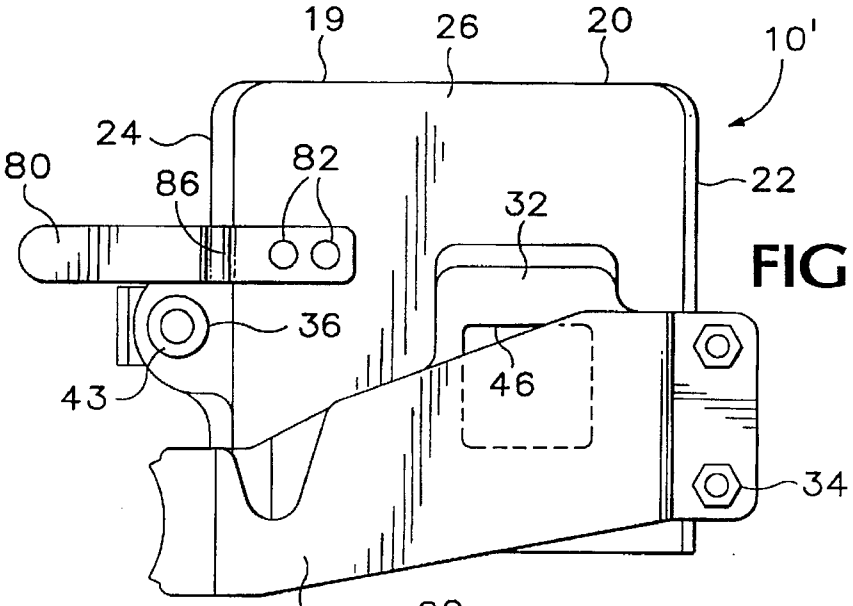
FIG. 9 is a right side elevational view of a spare magazine carrier which is an alternative embodiment of the invention.
Figure 10:
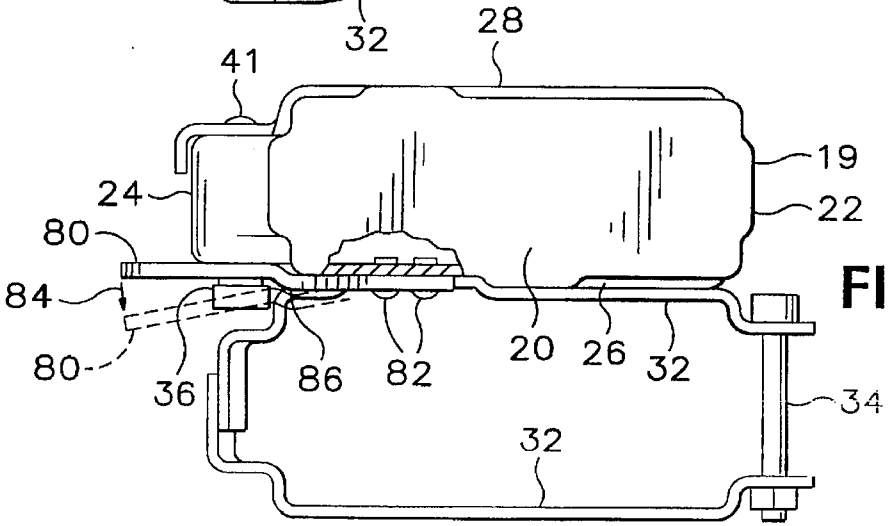
FIG. 10 is a partially cut-away top plan view of the spare magazine carrier shown in FIG. 9.
Figure 8:
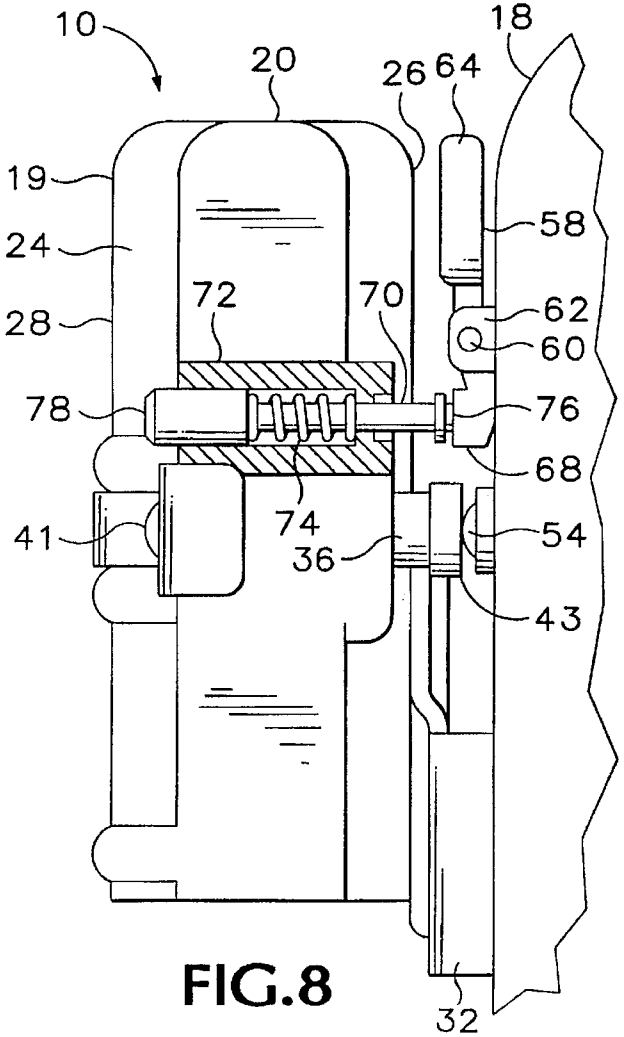
FIG. 8 is a sectional view of the spare magazine carrier and a portion of the rifle shown in FIG. 1, taken along line 8—8, on an enlarged scale.

While the plunger 70 previously disclosed is part of a preferred embodiment of the present invention, it will be understood also that a functional control extender according to the invention may take other forms. For example, as shown in FIGS. 9 and 10, in a spare magazine holder 10' which is in most respects similar to the spare magazine carrier 10, an elongate arm 80 of resilient material such as spring metal may be attached to the right side 26 of the body 19 by fasteners such as rivets 82 near one end of the arm 80. The other end of the arm 80 is left available extending rearwardly beyond the rear side 24 and clear of the body 19 of the spare magazine carried 10'. In such an arrangement, pushing the arm 80 in the direction indicated by the arrow 84 to the position indicated in broken line moves a portion such as the shoulder 86 of the arm 80 inwardly, or toward the right, so that it can push against the lower end 68 of the bolt hold-open lever 58 of the rifle 12.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A spare magazine carrier for use with a firearm, comprising:

(a) protective means for covering an open end of a magazine for a firearm;

(b) attachment means for mounting said protective means on said firearm;

(c) latch means associated with said protective means for releasably holding a loaded spare magazine in a location in which said protective means covers an open end of said spare magazine; and (d) extender means, mounted on said protective means, for operating a functional control device which is located on said firearm in a position at least partially hidden or obscured by said protective means when said protective means is mounted on said firearm.

2. A spare magazine carrier for use with a firearm having a receiver for removably holding a magazine in a position of operative engagement in said firearm in which the magazine extends downwardly from the receiver, said spare magazine carrier comprising:

(a) latch means for releasably engaging a loaded spare magazine; and (b) attachment means for holding said latch means in such a mounting position relative to said receiver that a loaded spare magazine, when engaged by said latch means, extends downwardly therefrom and is located alongside, generally parallel with, and at substantially the same position with respect to the length of said firearm as a magazine located in said position of operative engagement in said firearm; and (c) a control device extender carried on said attachment means and located in position to engage an operational control device of said firearm when said latch means is held in said mounting position relative to said receiver.

3. A spare magazine carrier for use with a firearm having a receiver and an operational control device located on said receiver, comprising:

(a) a protective receptacle for a spare magazine;

(b) a receptacle mounting device associated with said receptacle; and (c) a control device extender mounted on said receptacle in position to engage said operational control device when said receptacle is attached to said receiver by said carrier mounting device.

4. The spare magazine carrier of claim 3 wherein said operational control device extender includes a plunger mounted for reciprocal movement with respect to said receptacle.

5. The spare magazine carrier of claim 3 wherein said operational control device is a bolt catch lever.

6. The spare magazine carrier of claim 3 wherein said receptacle has an outer side, an inner side, and a rear side, and wherein said extender includes a plunger carried in a plunger housing and movable reciprocally, said plunger having a first end exposed adjacent said outer side and a second end exposed adjacent said inner side.

7. The spare magazine carrier of claim 6 wherein said plunger housing is located on said rear side of said receptacle.

8. In combination with a firearm including a receiver for receiving a magazine in a position of operative engagement therein, said receiver having a side and said firearm including an operational control device located on said side of said receiver, a spare magazine carrier for carrying a loaded spare magazine for said firearm, separate from and in addition to any magazine already in a position of operative engagement in said firearm, said spare magazine carrier comprising:

(a) a protective receptacle for a loaded spare magazine for a firearm;

(b) attachment means for mounting said receptacle on said firearm in a position adjacent said side of said receiver of said firearm;

(c) latch means associated with said receptacle, for releasably holding a loaded spare magazine in a location in which said receptacle covers an open end of said loaded spare magazine, with said loaded spare magazine located alongside and at substantially the same position relative to the length of said firearm as any magazine already in said position of operative engagement in said firearm; and (d) a control device extender carried on said receptacle in position to engage said operational control device when said receptacle is mounted on said firearm.

9. The spare magazine carrier of claim 8, including latch release means for selectively releasing said loaded spare magazine in response to releasing a magazine from said position of operative engagement in said firearm.

10. The spare magazine carrier of claim 8 wherein said control device is a bolt catch lever.

11. The spare magazine carrier of claim 8 wherein said protective means comprises a box-like body having a top and a plurality of sides, said body being adapted to cover an open end of a spare magazine, and said control device extender being associated with one of said sides of said body.

12. The spare magazine carrier of claim 8 wherein said attachment means includes a strap and means for tightening said strap around a portion of said receiver of said firearm.

* * * * *